US012805618B2

(12) United States Patent
Zhang et al.

(10) Patent No.: US 12,805,618 B2
(45) Date of Patent: Nov. 24, 2026

(54) FOLDABLE CASE FOR A DEVICE

(71) Applicant: iBenzer Inc., College Point, NY (US)

(72) Inventors: Lina Zhang, College Point, NY (US); Jiayue Xu, College Point, NY (US)

(73) Assignee: iBenzer INC., Garden City, NY (US)

( * ) Notice: Subject to any disclaimer, the term of this patent is extended or adjusted under 35 U.S.C. 154(b) by 0 days.

(21) Appl. No.: 18/737,377

(22) Filed: Jun. 7, 2024

(65) Prior Publication Data

US 2024/0423340 A1 Dec. 26, 2024

Related U.S. Application Data

(60) Provisional application No. 63/523,066, filed on Jun. 24, 2023.

(51) Int. Cl.
*A45C 13/00* (2006.01)
*A45C 11/00* (2006.01)

(52) U.S. Cl.
CPC ..... *A45C 13/005* (2013.01); *A45C 11/00* (2013.01); *A45C 11/002* (2025.01); *A45C 11/003* (2025.01)

(58) Field of Classification Search
CPC ..... H04B 1/3888; A45C 11/00; A45C 11/003; A45C 11/002; A45C 13/005
USPC ..... 455/575.1, 575.8, 575.4; 206/320, 305
See application file for complete search history.

(56) References Cited

U.S. PATENT DOCUMENTS

| | | | | | |
|---|---|---|---|---|---|
| 2,642,987 | A * | 6/1953 | Castelli | A45C 13/005 | 16/375 |
| 4,219,116 | A * | 8/1980 | Borkan | B65D 50/045 | 220/835 |
| 5,638,838 | A * | 6/1997 | Lombardi | A45C 13/005 | 132/294 |
| 5,738,214 | A * | 4/1998 | Wyss | E05D 15/502 | 206/372 |
| 10,790,869 | B1 * | 9/2020 | Loh | H04B 1/3888 | |
| 11,737,612 | B2 * | 8/2023 | Ahmed | A47K 10/185 | 248/311.2 |
| 2002/0153376 | A1 * | 10/2002 | Seidler | B65D 51/04 | 220/230 |
| 2013/0140202 | A1 * | 6/2013 | Benoit | B65D 25/04 | 206/278 |

FOREIGN PATENT DOCUMENTS

| | | | | |
|---|---|---|---|---|
| KR | 20200130901 A | * 11/2020 | ..... | A45C 11/002 |
| KR | 20230157043 A | * 11/2023 | ..... | A45C 11/002 |
| WO | WO-2021162455 A1 | * 8/2021 | ..... | A45C 11/003 |

* cited by examiner

*Primary Examiner* — Chun Hoi Cheung
(74) *Attorney, Agent, or Firm* — iPA & iPM

(57) ABSTRACT

A protective case for a computing device, comprising a first cover, a second cover, and a hinge piece connecting the first and second covers. The first cover is configured to enclose and to capture at least a first portion of the computing device's main body and its perimeter. The second cover is configured to enclose and to capture at least a second portion of the computing device's main body and its perimeter. The hinge piece protects the joint of rotation of the foldable device, with a range that supports the first and second covers to rotate from a fully closed position to a fully opened position.

20 Claims, 15 Drawing Sheets

FOLDABLE CASE FOR A DEVICE

CROSS-REFERENCES TO RELATED APPLICATIONS

This application claims priority to an U.S. Provisional Application No. 63/523,066 filed on Jun. 24, 2023, which is hereby incorporated herein by reference in its entirety.

TECHNICAL FIELD

The present disclosure, in some embodiments thereof, relates to a hinged protection mechanism. More specifically, the present specification discloses a foldable case for a device with a mechanism to protect its joints where rotation takes place.

BACKGROUND OF THE DISCLOSURE

A foldable case for a device often comprises two pieces. Using a conventional laptop as an example, one piece covers the lid, and one piece covers the base. These two pieces are connected indirectly via the joint of the laptop. The joint of the laptop, in this configuration, is often exposed to some degree. The present disclosure is for a case that protects the joint as well as the body of the device. It applies to laptop as well as to foldable phones, tablets, and so on.

BRIEF SUMMARY OF EMBODIMENTS

The present disclosure, in some embodiments thereof, relates to a hinged protection mechanism. More specifically, the present specification discloses a foldable case for a device with a mechanism to protect its joints where rotation takes place.

A protective case for a computing device, comprising a first cover, a second cover, and a hinge piece connecting the first and second covers. The first cover is configured to enclose and to capture at least a first portion of the computing device's main body and its perimeter, with a first row of knuckles situated along an edged abutting the second cover. The second cover is configured to enclose and to capture at least a second portion of the computing device's main body and its perimeter. A recess is disposed between the second cover and the computing device with its length and width set to enclose that of a leaf portion of the hinge piece. The hinge piece comprises a second row of knuckles in complement to that of the first row of knuckles on the first cover. The leaf portion of the hinge piece is flexible and slides within the recess with a range that supports the first and second covers to rotate from a fully closed position to a fully opened position.

A protective case for a computing device, comprising a first cover, a second, and a hinge piece connecting the first and second covers. The first cover is configured to enclose and to capture at least a first portion of the computing device's main body and its perimeter A recess is disposed between the first cover and the computing device with its length and width set to enclose that of a leaf portion of the hinge piece. The second cover is configured to enclose and to capture at least a second portion of the computing device's main body and its perimeter, with a first row of knuckles situated along an edged abutting the first cover. The hinge piece comprises a second row of knuckles in complement to that of the first row of knuckles on the second cover. The leaf portion is flexible and slides within the recess with a range that supports the first and second covers to rotate from a fully closed position to a fully opened position.

In an exemplary embodiment, the leaf portion of the hinge piece further comprises a plurality of slits which serve as tracks to allow relative motion between the slits and a plurality of raised positioners fixed onto the recess of the first cover and/or the second cover.

The first and second row of knuckles are joined via a pin through barrels of the first and second rows of knuckles.

The first and second row of knuckles can also be joined via magnetic forces.

The first and second row of knuckles can be configured to snap into one anther via a figure-ground configuration.

The first and second row of knuckles can be replaced by a plurality of pairs of latches and receiving slots, wherein the latch comprises a hook profile.

In an exemplary embodiment the recess is raised above the first cover and/or the second cover via a preset displacement.

The recess can be configured to sit flush with outside surface of the first cover and/or the second cover.

The recess can be configured to be completely enclosed within walls of the first cover and/or the second cover.

In an exemplary embodiment, the hinge piece comprises preset textures.

A protective case for a computing device, comprising a first cover, a second cover, and a hinge piece connecting the first and second covers. The lid is configured to enclose and to capture at least a first portion of the computing device's main body and its perimeter. A first recess is disposed between the first cover and the computing device with its length and width set to enclose a first leaf portion of the hinge piece. The second cover is configured to enclose and to capture at least a second portion of the computing device's main body and its perimeter. A second recess is disposed between the second cover and the computing device with its length and width set to enclose a second leaf portion of the hinge piece. The hinge piece is flexible with first and second leaf portions slide within the first and second recess respectively with a range that supports the first cover and the second cover to rotate from a fully closed position to a fully opened position.

The first leaf portion of the hinge piece may further comprise a plurality of slits which serve as tracks to allow relative motion between the slits and a plurality of raised positioners fixed onto the recess of the first cover.

The second leaf portion of the hinge piece may further comprise a plurality of slits which serve as tracks to allow relative motion between the slits and a plurality of raised positioners fixed onto the recess of the second cover.

The first and/or second recess can be raised above the first and/or second covers via a preset displacement.

The first and/or second recess can sit flush with outside surface of the the first and/or second covers.

The first and/or second recess can be configured to be completely enclosed within walls of the first and/or second covers.

In an exemplary embodiment, the hinge piece comprises preset textures.

Other features and aspects of the disclosure will become apparent from the following detailed description, taken in conjunction with the accompanying drawings, which illustrate, by way of examples, the features in accordance with embodiments of the disclosure, The summary is not intended to limit the scope of the disclosure, which is defined solely by the claims attached hereto.

BRIEF DESCRIPTION OF DRAWINGS

The present disclosure, in accordance with one or more various embodiments, is described in detail with reference to the following figures. The drawings are provided for purposes of illustration only and to merely depict typical or example embodiments of the disclosure. These drawings are provided to facilitate the reader's understanding of the disclosure and shall not be considered limiting of the breadth, scope, or applicability of the disclosure. It should be noted that for clarity and ease of illustration these drawings are not necessarily made to scale.

Some of the figures included herein illustrate various embodiments of the disclosure from different viewing angles. Although the accompanying descriptive text may refer to such views as "top," "bottom" or "side" views, such references are merely descriptive and do not imply or require that the disclosure be implemented or used in a particular spatial orientation unless explicitly stated otherwise.

Figure 1:
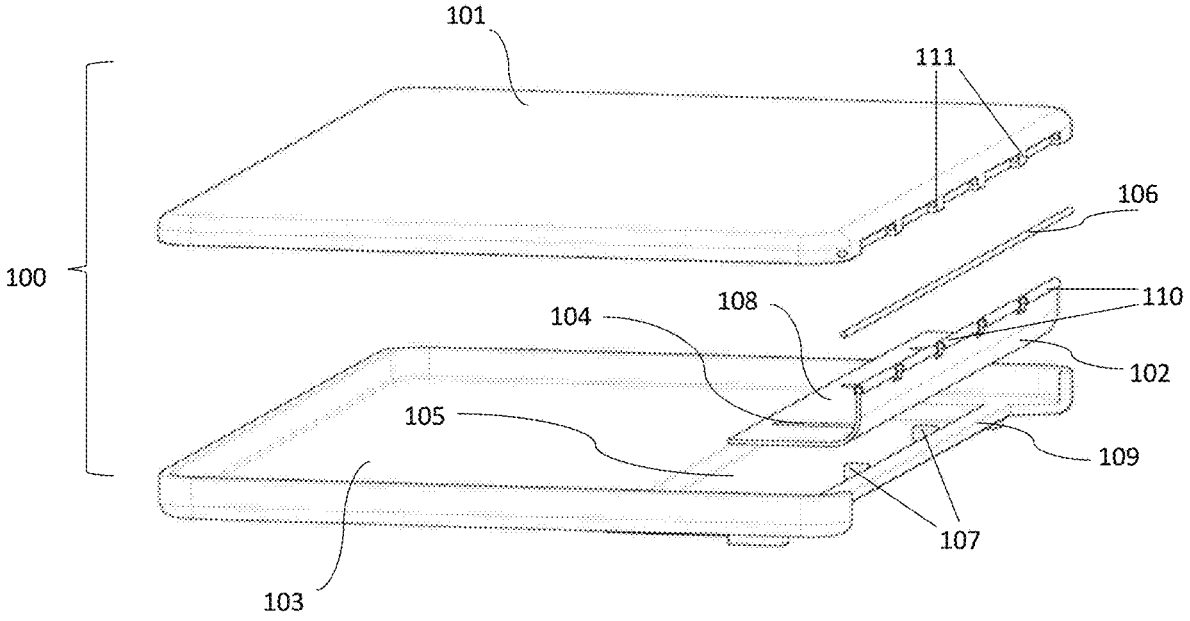
FIG. 1 is an exploded perspective view of a laptop case with a lid, a hinge piece, and a base.

The figures are not intended to be exhaustive or to limit the disclosure to the precise form disclosed. It should be understood that the disclosure can be practiced with modification and alteration, and that the disclosure be limited only by the claims and the equivalents thereof.

DETAILED DESCRIPTION OF EMBODIMENTS OF THE DISCLOSURE

The description and/or disclosure that follow comprise illustrative systems, methods, techniques, sequence instructions, and computing machine program products that embody illustrative embodiments. In the following description, for purpose of explanation, numerous specific details are set forth in order to provide an understanding of various embodiments of the inventive subject matter.

From time-to-time, the present disclosure is described herein in terms of example environments. Description in terms of these environments is provided to allow the various features and of the disclosure to be portrayed in the context of an exemplary application. It will be evident, however, to one of ordinary skill in the art how the disclosure can be implemented in different and in alternative environments, with or without specific details. In general, well-known instruction instances, protocols, structures, and techniques have not been shown in great detail.

Unless defined otherwise, all technical and scientific terms used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The present disclosure, in some embodiments thereof, relates to a hinged protection mechanism. More specifically, the present specification discloses a foldable case for a device with a mechanism to protect its joints where rotation takes place.

For simplicity reasons, most of the following descriptions are using a laptop as an example, which often has a screen portion (referring to as a lid), and a keyboard portion (referring to as a base). More generally speaking, one can refer to the terms of a first cover and a second cover, each protecting a corresponding portion of a computing device. A hinge piece protects the folding joint by connecting the first and second covers. This configuration applies to foldable phones, tablets, as well as to laptops.

FIGS. 1-5 illustrate several perspective and sectional views of an exemplary embodiment of a case with a sliding hinge piece. Exploded perspective views in FIGS. 1-3 disclose a case 100, with a lid portion 101, a base 103, and a hinge piece 102. The hinge piece 102 comprises a set of knuckles 110, which compliments another set of knuckles 111 configured along an edge of the lid 101. A pin 106 passes through a space, formed by both sets of knuckles 110 and 111, to form a rotatable joint between the lid 101 and the hinge piece 102. A recess 105 is configured onto the base 103 to receive a leaf portion 108 of the hinge piece 102. The leaf portion 108 of the hinge piece may further comprises a set of parallel slits 104. The slits 104 allows the hinge piece to make translational movement within recess 105 while restricted by a corresponding set of anchors 107, which are also configured onto the base of the recess 105.

Figure 2:
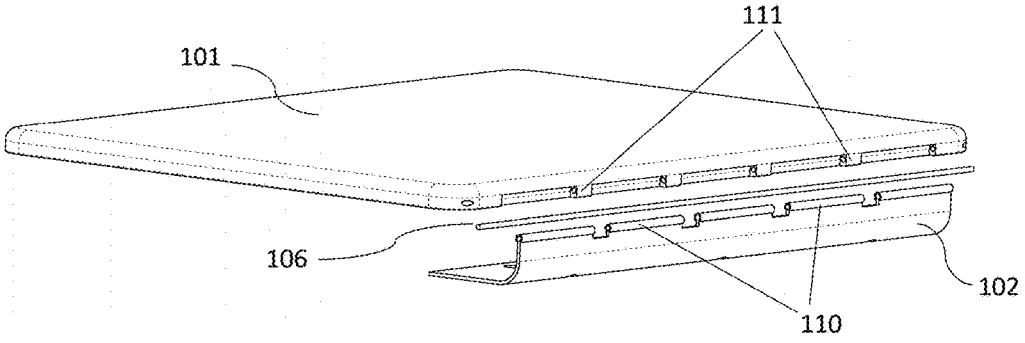
FIG. 2 is an exploded perspective view from a different angle of a lid and a hinge piece.
Figure 3:
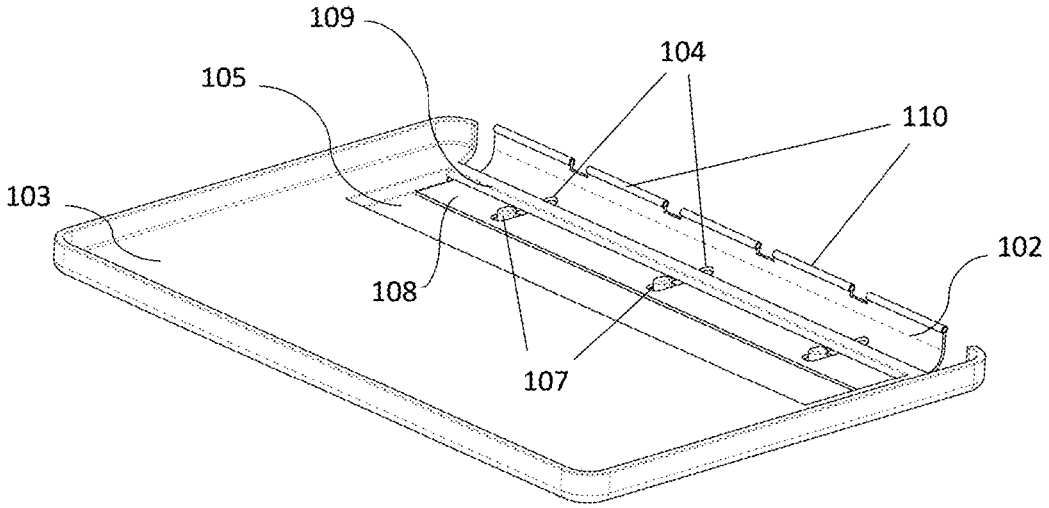
FIG. 3 is an exploded perspective view from a different angle of a base and a hinge piece.

FIG. 2 illustrates an exploded perspective outside view of the hinge joint comprising: knuckle set 111 configured along the edge of the lid 101, pin 106, and knuckle set 110 along the edge of the hinge piece 102. Both sets of knuckles complement each other in spacing and in size and are joined via a pin 106. As the lid 101 opens and closes, it rotates around the hinge joint configured along its own edge. FIG. 3 is an inside perspective view of the base 103 fitted with a hinge piece 102. Dimensions of recess 105 compliment that of the leaf portion 108 of the hinge piece 102. Parallel slits 104 are restricted by corresponding anchors 107. A reinforcement bridge 109 connects both end portions of the base 103.

Figure 4:
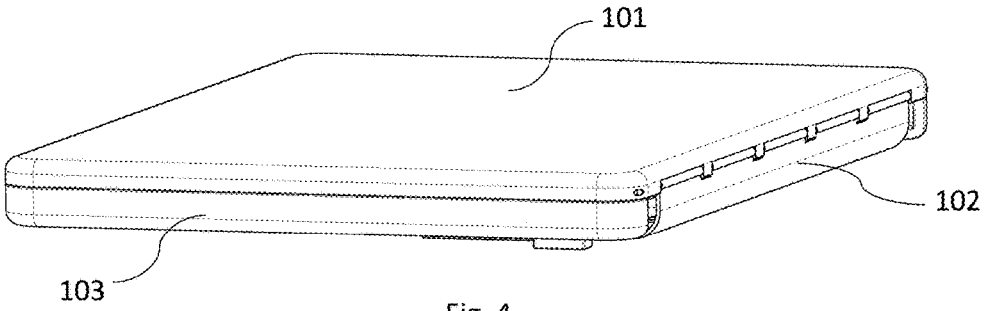
FIG. 4 is a perspective view of the case in a fully closed configuration.
Figure 5:
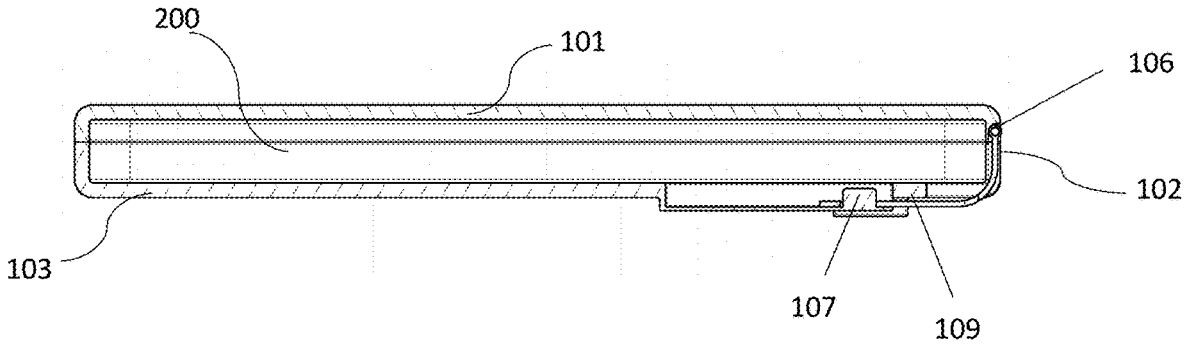
FIG. 5 is cross sectional view of the case in FIG. 4.

FIGS. 4 and 5 illustrates the lid 101, the hinge piece 102, and the base 103 in an assembled and closed position, thus enclosing and protecting a device 200 within. FIG. 5 is a cross sectional view with hashes to show cut away surfaces further including the anchor 107, the reinforcement bridge 109, and the pin 106.

Figure 6:
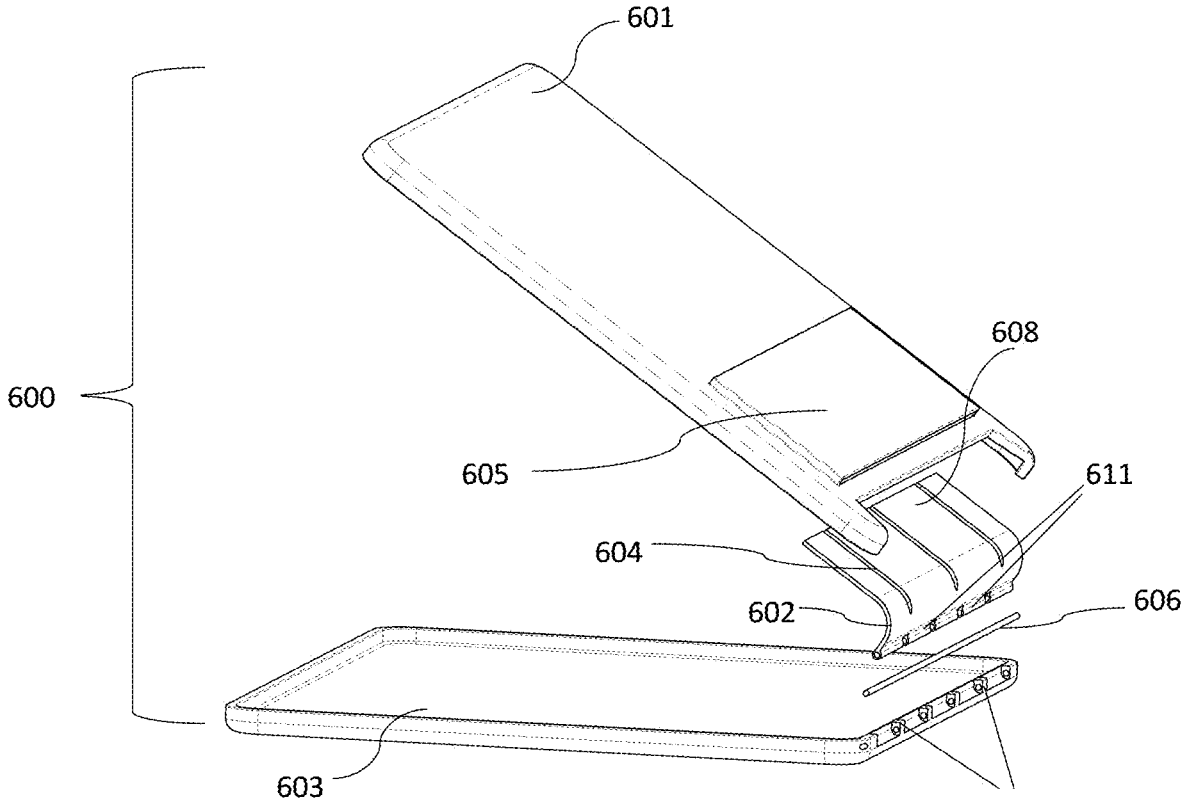
FIG. 6 is an exploded view of a variation of a case with a lid, a hinge piece, and a base.
Figure 7:
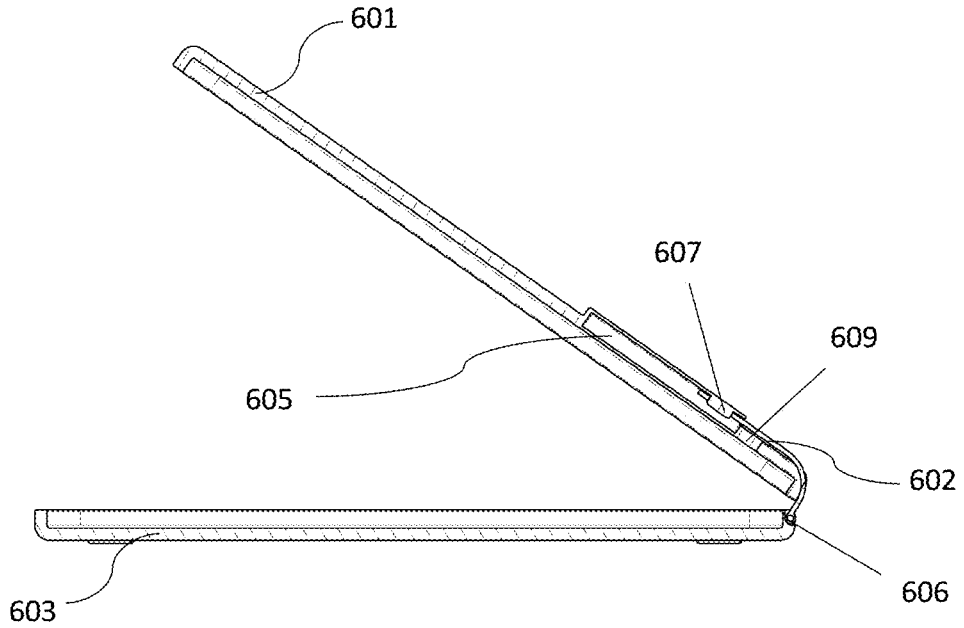
FIG. 7 is cross sectional view of the case in FIG. 6.

FIGS. 6 and 7 illustrate an exemplary embodiment where a hinge joint is configured along an edge of the base, instead of along an edge of the lid as illustrated in FIGS. 1-5. A case 600 comprises a lid 601, a hinge piece 602, and a base 603. A recess 605 is configured onto the lid 601 to receive and to accommodate movements of a leaf portion 608 of the hinge piece 602. The hinge piece 602 comprises a set of knuckles 611, which compliments another set of knuckles 610 configured along an edge of the base 603. A pin 606 passes through a space, formed by both sets of knuckles 611 and 610, to form a rotatable joint between the lid 601 and the hinge piece 602. As the lid 601 opens and closes, it rotates around the hinge joint configured along the edge of the base 603. The leaf portion 608 of the hinge piece may further comprises a set of parallel slits 604. The slits 604 allows the hinge piece to make translational movement within recess 605 while restricted by a corresponding set of anchors 607, which are also configured onto the recess 605. FIG. 7 is a cross sectional view with hashes to show cut away surfaces further including anchor 607, reinforcement bridge 609 connecting both end portions of the lid 601, and pin 606.

Hinge pieces 102 and 602 are made of stiff yet flexible and bendable material. The leaf portions 108 and 608 can be manufactured with textures to increase/decrease stiffness and/or surface friction. FIGS. 10, 13, 26, and 27 gave several examples of texture that can be employed. Other texture pattern can certainly substitute the ones shown as mere examples.

Number of pairs of slits 104 and 604 in correspondence with anchors 107 and 607 can be set from zero and above. Zero or no slit/anchor examples are shown in FIGS. 14-17.

Figure 8:
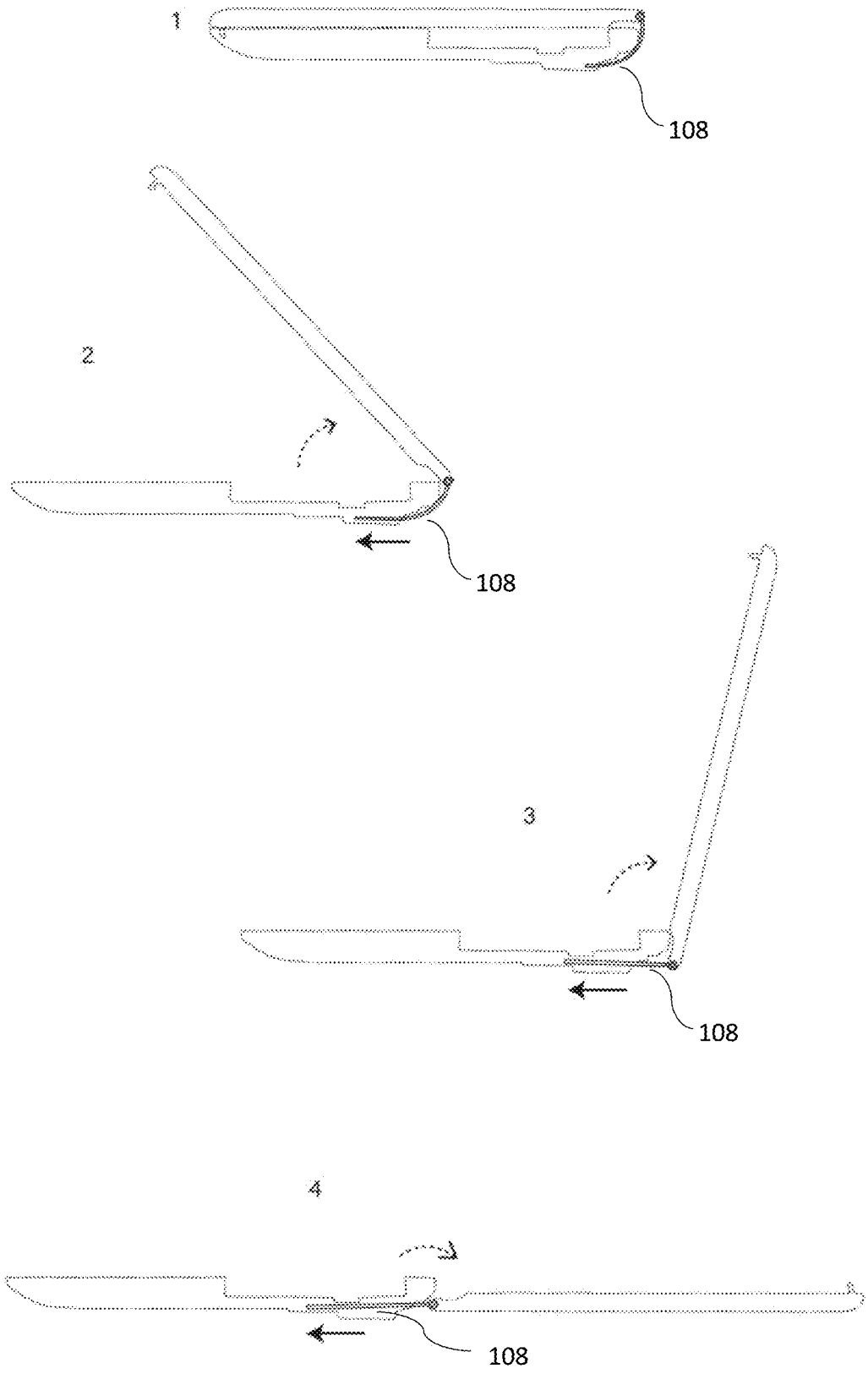
FIG. 8 illustrates a cross sectional view of a case with a hinge piece anchored to the lid, and a schematic sequence of movements of the hinge piece.
Figure 9:
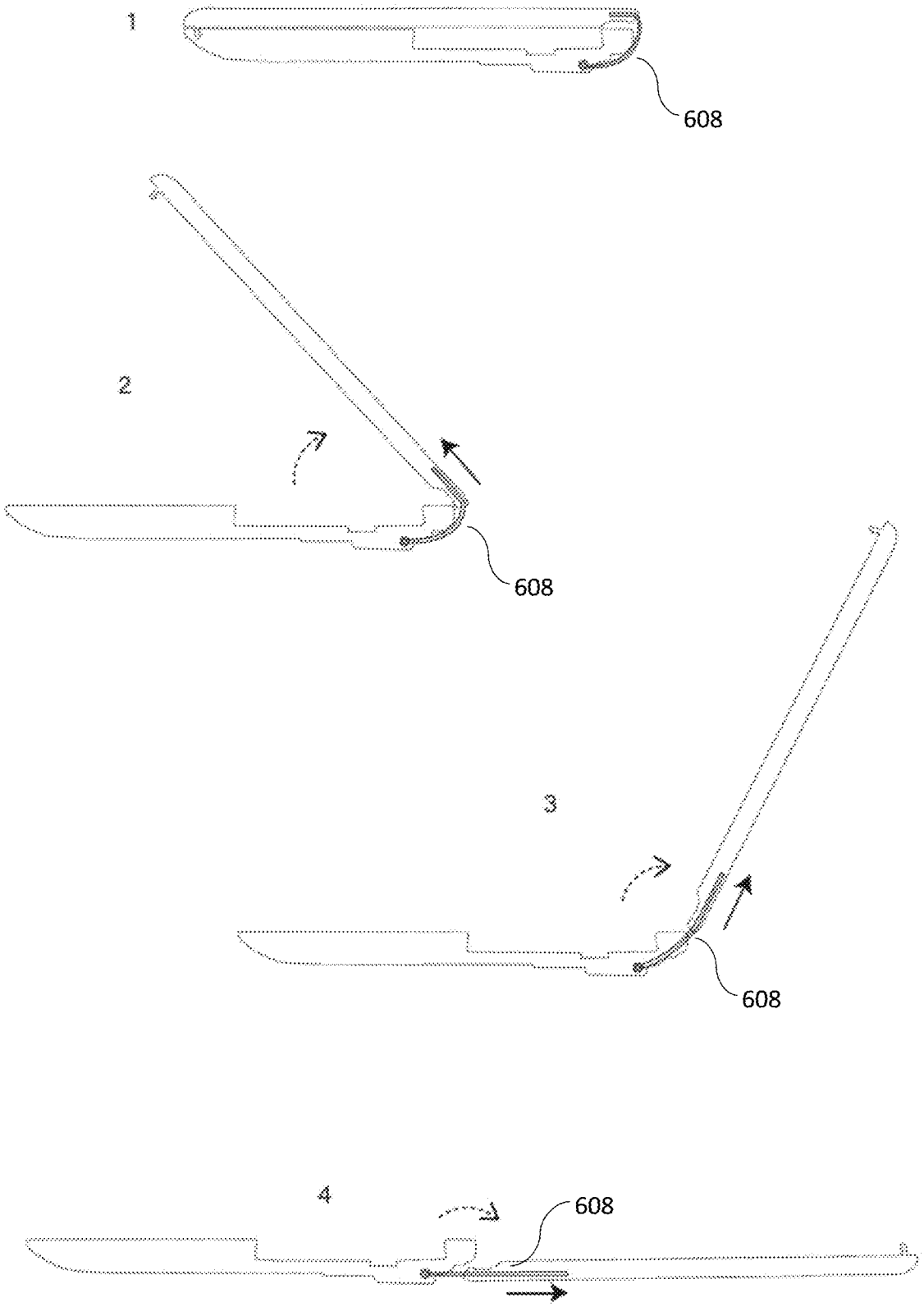
FIG. 9 illustrates a sectional view of a case with a hinge piece anchored to the base, and a schematic sequence of movements of the hinge piece.
Figure 10:
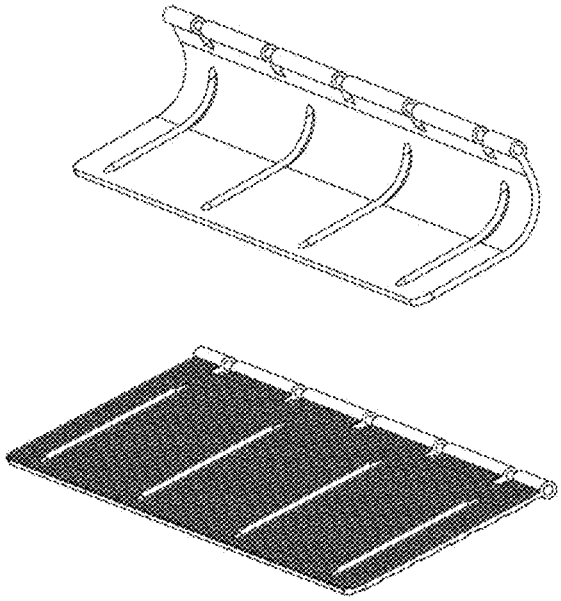
FIG. 10 is a perspective view of the hinge piece with and without texture.
Figure 11:
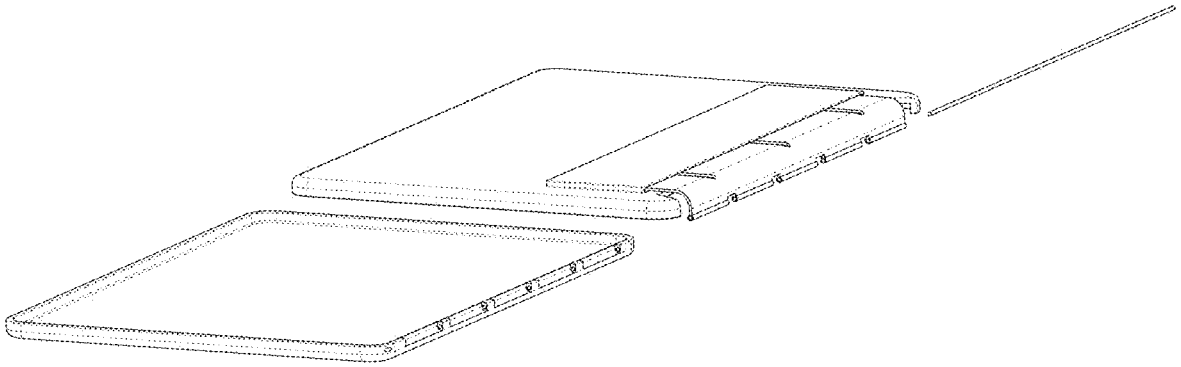
FIG. 11 is an exploded view of the hinge piece and a connection pin.

When the lid opens and closes with respect to the base, the leaf portion of the hinge piece bends and slides within its designated recess. Schematic side views in FIG. 8 illustrate various positions and movements of the leaf portion 108 when the hinge joint is configured along the edge of the lid 101. As the lid rotates and transitions from a closed position 1 to various opened positions 2, 3, and 4, following broken line arrows, the leaf portion 108 slides further into the recess on the base, following the direction of solid arrows. Schematic side views in FIG. 9 illustrate various positions and movements of the leaf portion 608 when the hinge joint is configured along the edge of the base 603. As the lid rotates and transitions from a closed position 1 to various opened positions 2, 3, and 4, following broken line arrows, the leaf portion 608 slides further into the recess on the lid, following the direction of solid arrows. Width and height of the leaf portions 108 and 608 complements that of corresponding recesses 105 and 605, which are in turn, determined by the size of the device that the case encloses.

FIGS. 10-13 illustrate a variety of exemplary hinge joint connections. An example of a classic barrel hinge joint is shown in FIGS. 1, 2, 6, 10 and 11. Both sets of knuckles, 110~111 and 610~611, fit into each other and constitute a continuously hollow cavity, namely a loop or a barrel. A pin 106 or 606 passes through the continuous hollow cavity and to secure the hinge piece with either the lid or the base. Rotation happens around the barrel and the pin as the lid opens or closes with respect to the base.

Figure 12:
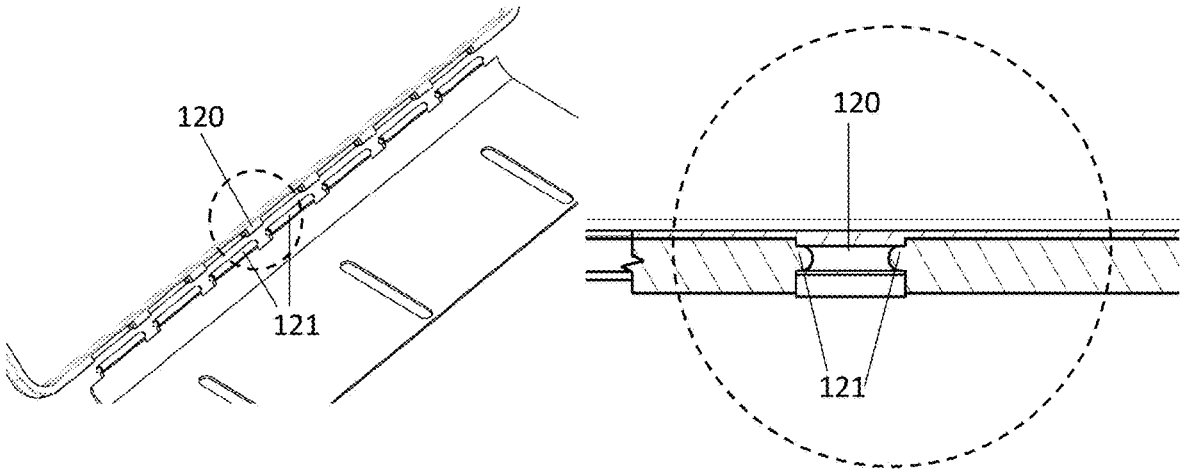
FIG. 12 illustrates a perspective and a enlarged sectional view of knuckles with complimentary figure-ground type snap configuration.
Figure 13:
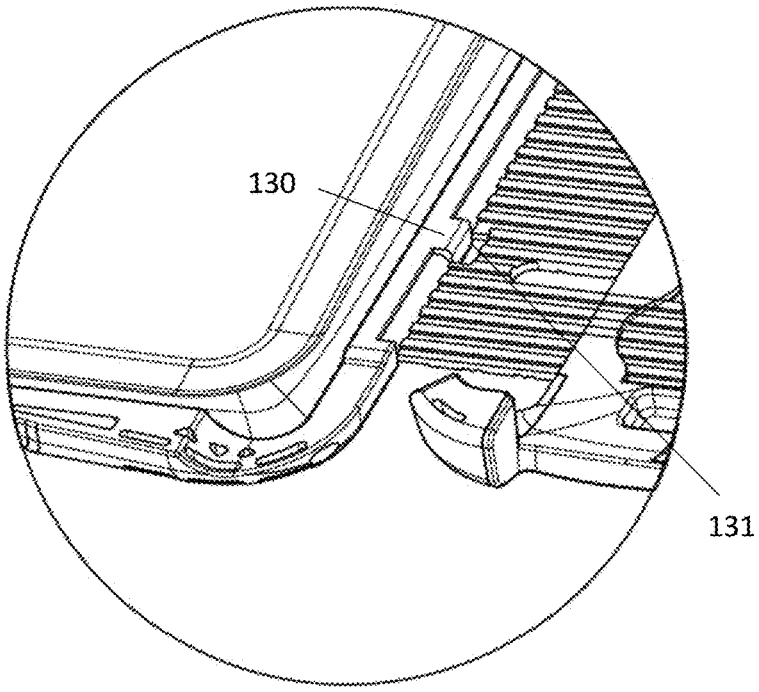
FIG. 13 illustrates a latch type of connections between the hinge piece with either a lid or a base.

FIG. 12 illustrate a figure-ground type of snap in knuckle joint 120~121. The right side enlarged sectional view corresponds to the region in the broken line circle in the left side perspective view. A concave knuckle 120 is flanked by convex knuckles 121 on both sides. Rotation happens when the convex knuckles 121 rotate within the concave receiving knuckle 120. The pair 120~121 rotate around a same axis (as if having an actual pin passing through), but in opposite direction. FIG. 13 shows a latch type joint, where a footed end 130 with a hook like profile latches onto a receiving slot 131. It should be noted that the figures are merely for illustration purpose. Various hinge joint connections depicted in FIGS. 10-13 can have one or more either the same or different types. The number of hinge joint connections, for instance number of knuckle pairs that are required for a specific case, depends on the width and depth of the device that it is designed to protect. At least one pair of either type of hinge joint connection is needed for rotation between the lid and the base.

Figure 14:
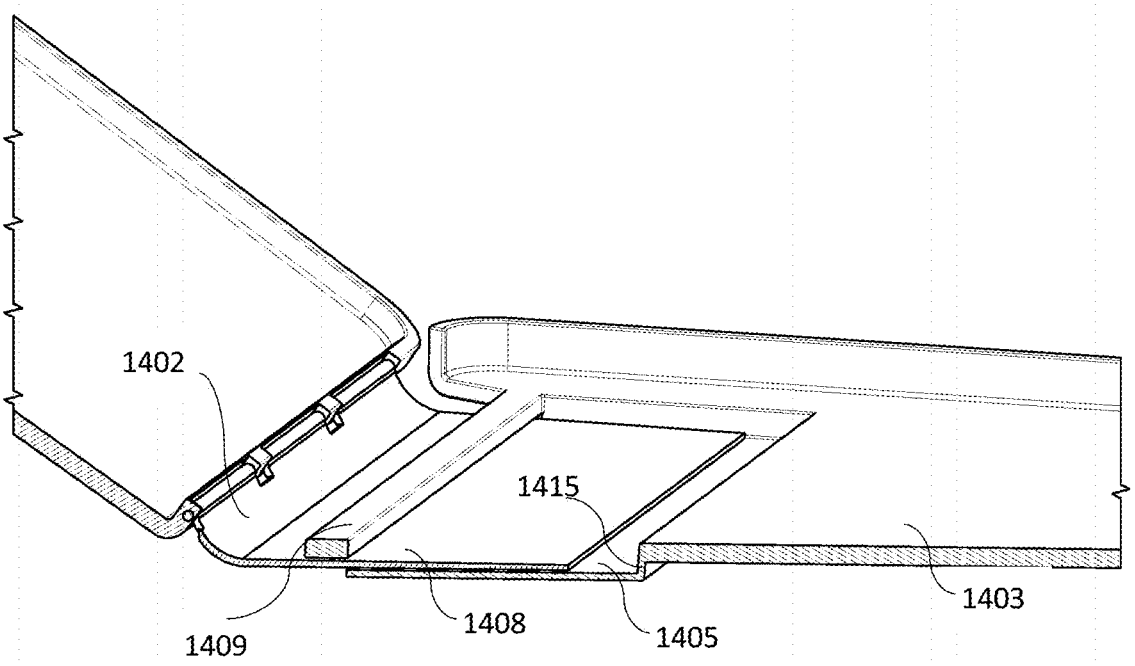
FIG. 14 is a perspective sectional view of the hinge piece without slits.
Figure 15:
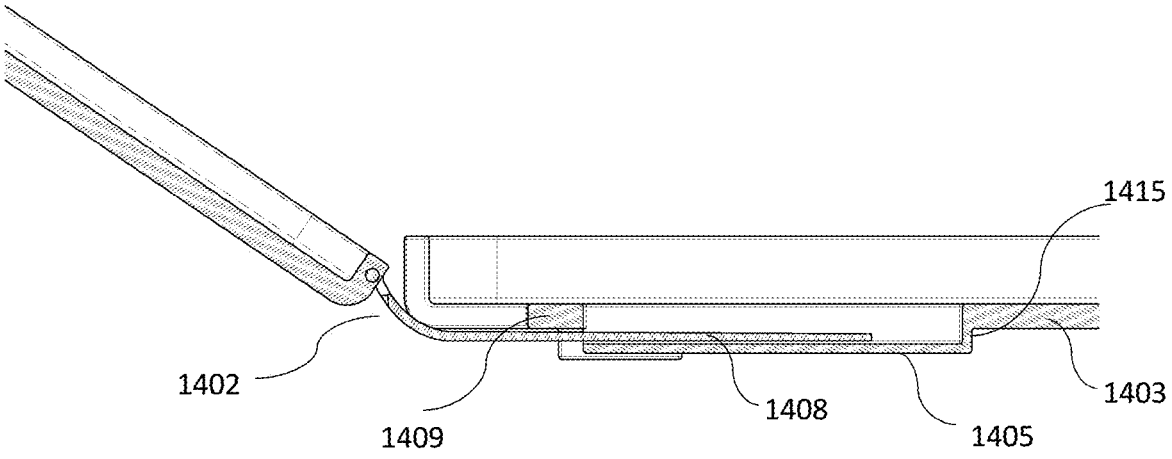
FIG. 15 is a side view of FIG. 14.

FIGS. 14-17 illustrates several exemplary configurations of a recess, analogous to 105 and 605 in FIGS. 1, 3, 5, and 6-7. The functionality of the recess is to accommodate and to restrict movements of the leaf portion of the hinge piece. FIG. 14 is a perspective sectional view of a case. FIG. 15 is a frontal sectional view thereof. Surface of the recess 1405 is generally parallel to that of the base 1403. Recess 1405, however, is displaced by a preset amount around area 1415. The step displacement 1415 allows the recess to sit slightly outside of the base and thus creating extra space for the leaf portion 1408 of the hinge piece 1402 to be fitted between the recess 1405 and the reinforcement bridge 1409. A perspective outside view of the recess in FIG. 6 shows an analogous recess 605 sitting slight outside of the lid, similar to an extra pocket.

Figure 16:
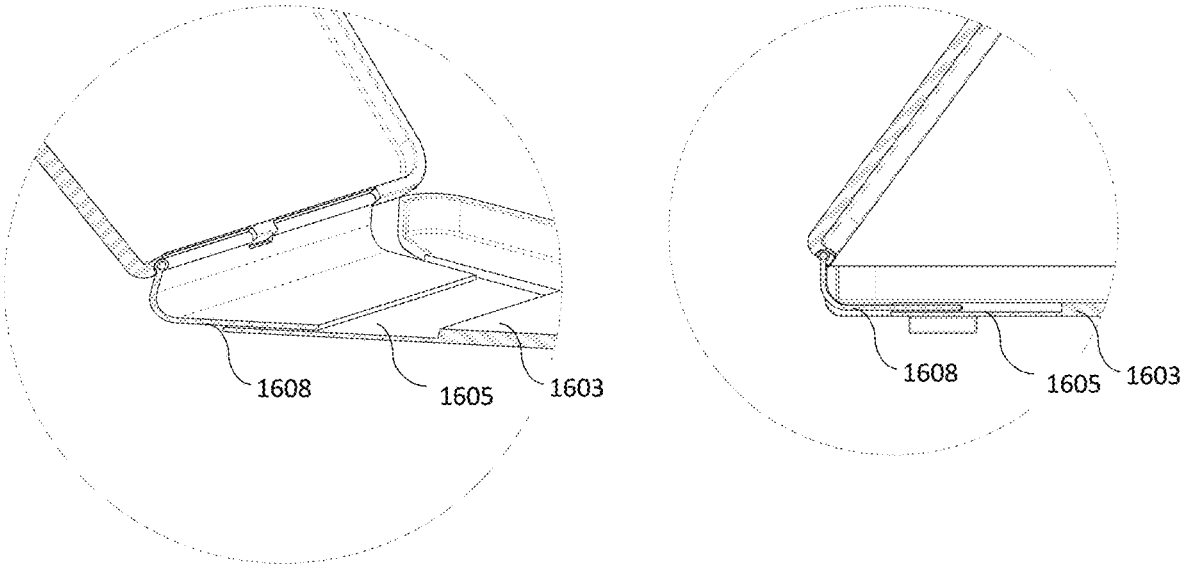
FIG. 16 is a perspective and cross sectional view of a variation of the receiving slot.
Figure 17:
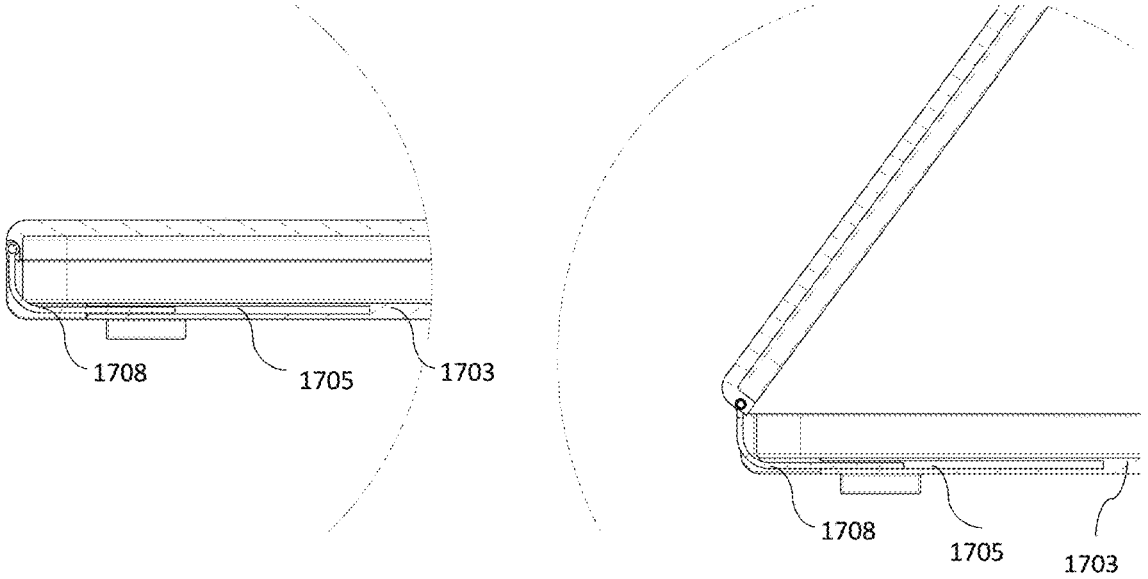
FIG. 17 is perspective and cross sectional view of another variation of the receiving slot.
Figure 20:
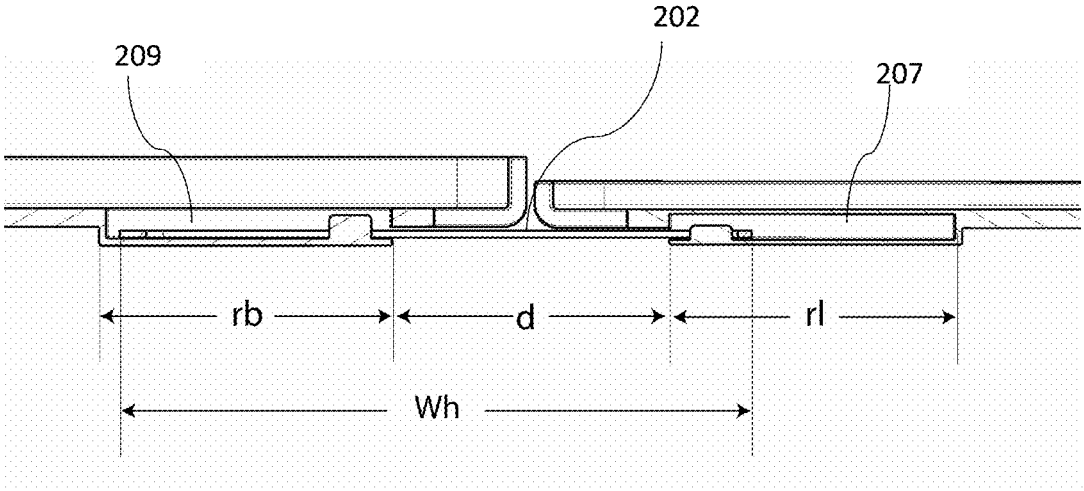
FIG. 20 is a side view of FIG. 19 with the case in a fully opened position.
Figure 21:
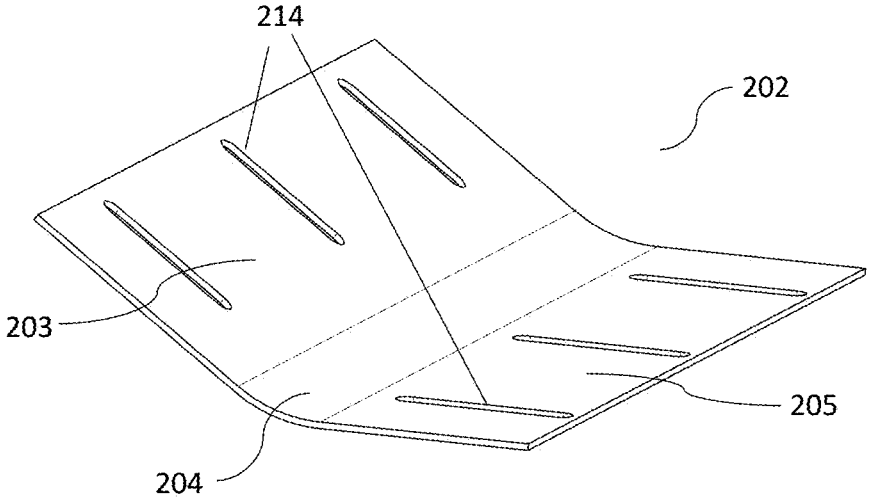
FIG. 21 is a perspective view of a two leaf hinge piece.
Figure 22:
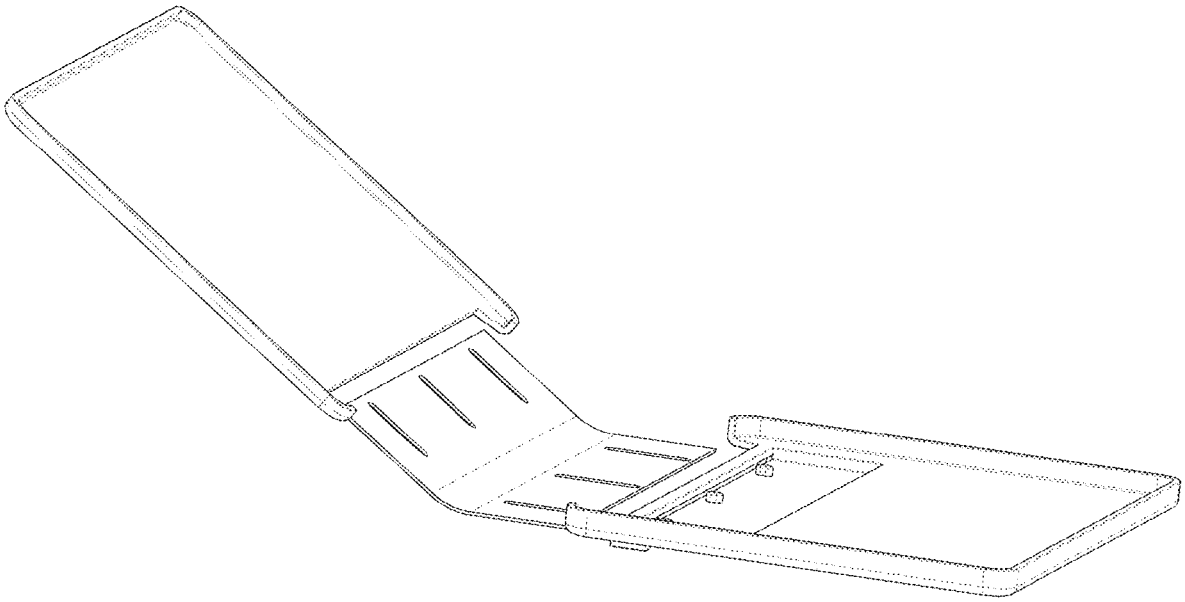
FIG. 22 is an exploded perspective view of a case from inside.

FIG. 16 is a perspective and frontal sectional view of the case with step displacement set to be zero. The outside surface of the base 1605 and 1603 is coplanar and continuous. The thickness of the recess 1605 is less than that of the base 1603. In this scenario, the outside view of the case does not show an extra pocket. The lid and the base appear to be smooth and continuous from the outside. The recess 1605 and the leaf portion 1608 of a hinge piece can only be viewed from the inside as shown in the perspective view in FIG. 16. FIG. 17 illustrates two sectional views of a recess 1705 completely enclosed or within the walls of the base 1703. In this configuration, the recess 1705 became a hidden cavity within the base 1703 and cannot be seen from inside or outside. The leaf portion 1708 of a hinge piece appears to just slide in and out of the base 1703 itself. No reinforcement bridge is necessary in configurations disclosed in FIGS. 16 and 17. FIGS. 18-25, and 27 illustrate several schematics of a hinge piece comprising two leaf portions connected continuously and without a hinge joint connection. An exemplary two-leaf hinge piece 202 is illustrated in FIG. 21. In general, an area that is configured for insertion into a recess 207 in the lid is designated as leaf portion 203. An area that is configured for insertion into a recess 209 in the base is designated as leaf portion 205. A connecting area in between the two leaf portions are designated as 204. FIG. 22 is an exploded perspective inside view of the two leaf hinge piece 202, the lid, and the base, when the case is disassembled and in an opened state.

Figure 18:
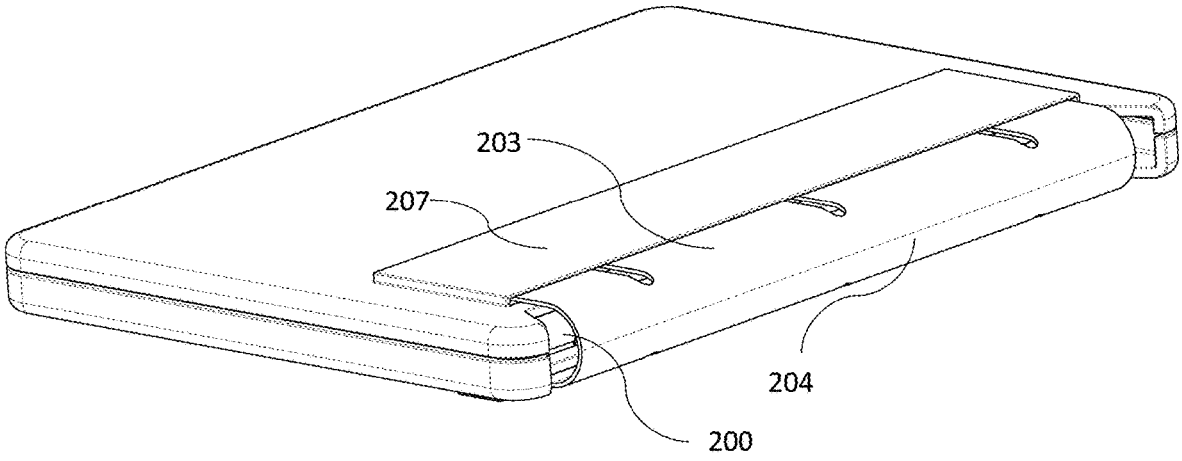
FIG. 18 is an outside perspective view of a two leaf hinge piece.
Figure 19:
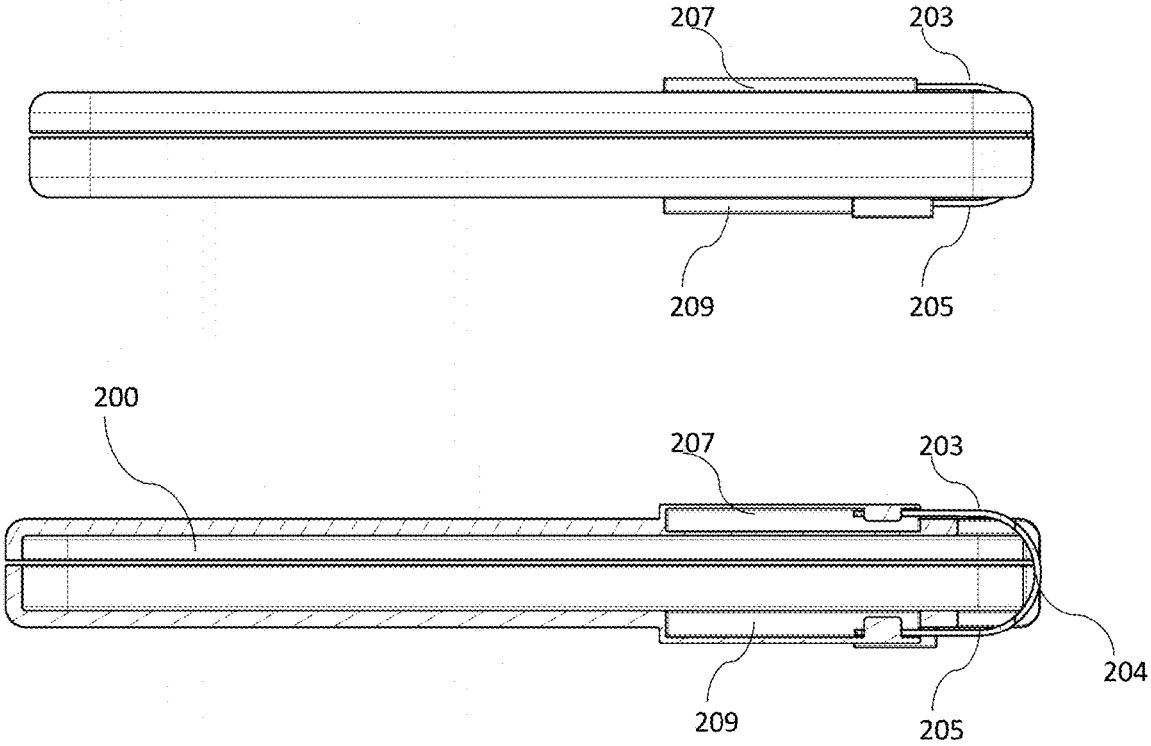
FIG. 19 is a side view and a side sectional view of the case in FIG. 18.

FIGS. 18 and 19 shows various assembled and closed view of the case. For illustration purpose, recesses 207 and 209 are analogous to the ones illustrated in FIGS. 6 and 15, with a step displacement from either the lid or the base. When the case is assembled and closed, connecting area 204 wraps around and protects the outside of the joint area of the device 200. FIG. 19 is a side view of FIG. 18, with a cut away cross sectional view below, to further illustrate inner configuration of the case and relations among each component.

The two-leaf hinge piece 202 can just be a continuous and uniform piece made with stiff yet flexible material. Slits 214 is not always necessary. After insertion, it slides back and forth between the recess of the lid and the base when the device opens and closes. For simplicity, FIG. 20 illustrates a side view of a completely opened case with a two-leaf hinge piece 202. Width of the recess 209 is designated as rb. Width of the recess 207 is designated rl. Closest distance between recess 209 and 207 is designated as d. Width of the two-leaf hinge piece 202 is designated as Wh. As the case opens and closes, the two-leaf hinge piece 202 slides freely between both recesses. In general, for the hinge piece to not fall out of either recess during movement, the total width of the hinge piece is set to be larger than the width of either recess combined with the distance in between, ie., to satisfy $Wh>(rb+d)$ and $Wh>(rl+d)$ simultaneously. Distance d between the recesses is largest when the device is in a closed position. Distance d, therefore, can be tailored based primarily on the thickness of the device while taking into consideration the range of motion between the lid and the base.

Figure 23:
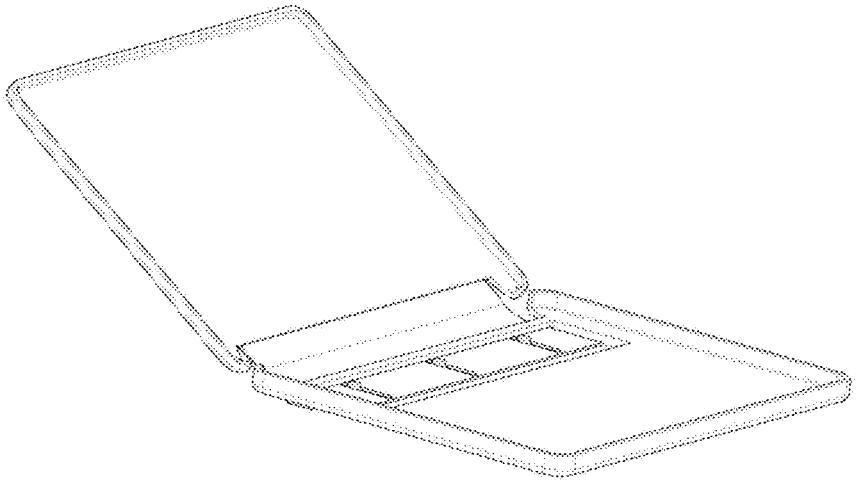
FIG. 23 is a perspective inside view of the case assembled.
Figure 24:
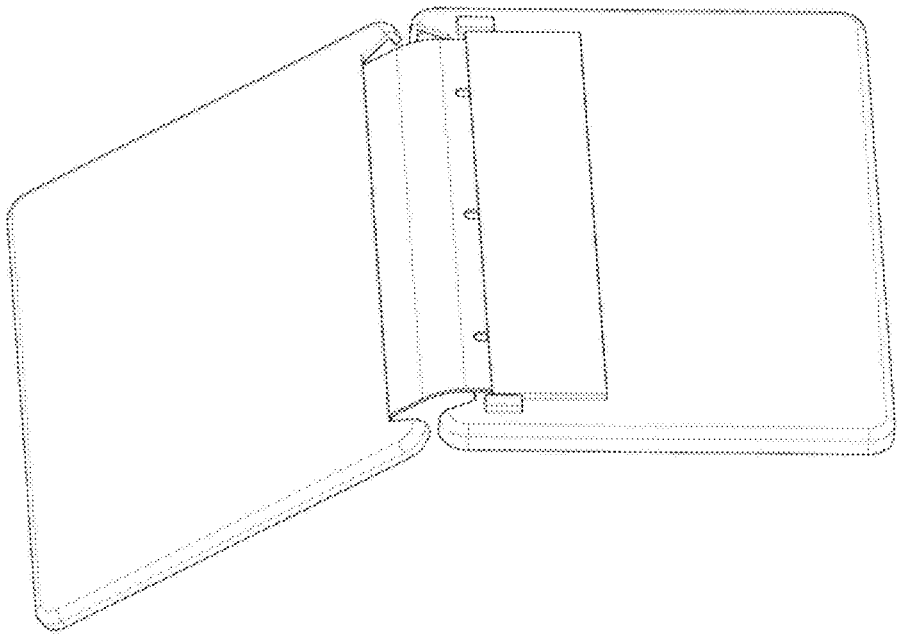
FIG. 24 is a perspective outside view of the case assembled.
Figure 25:
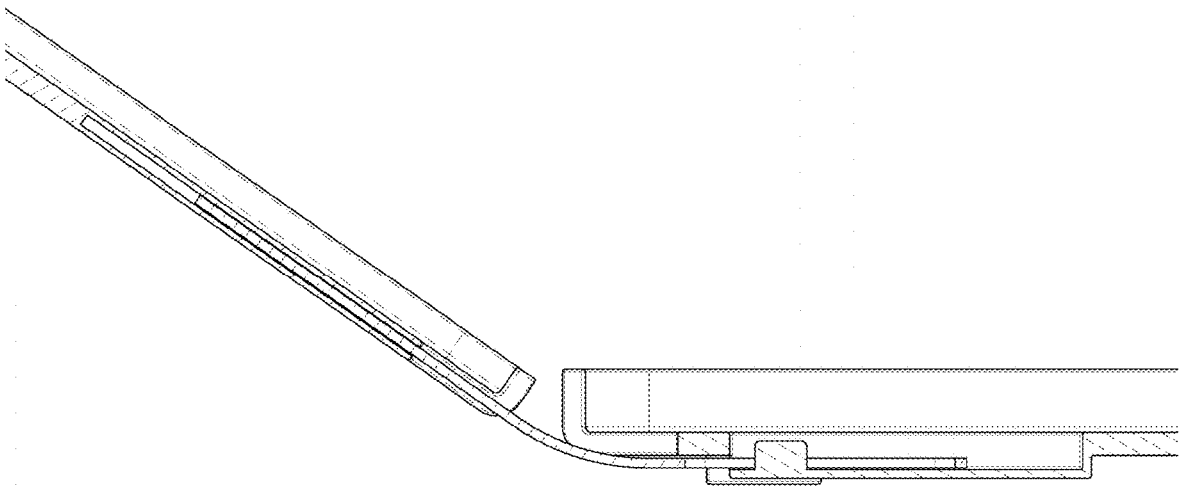
FIG. 25 is a cross sectional view of the case with a two leaf hinge piece.
Figure 26:
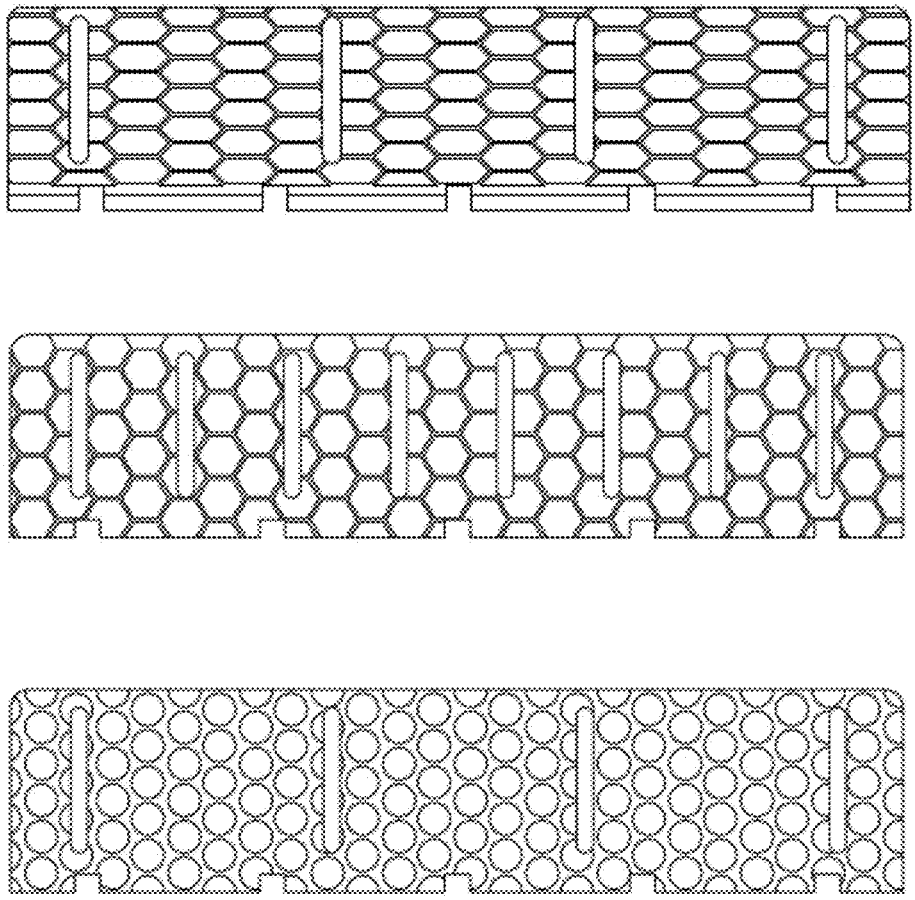
FIG. 26 illustrates exemplary textures for a single leaf hinge piece.
Figure 27:
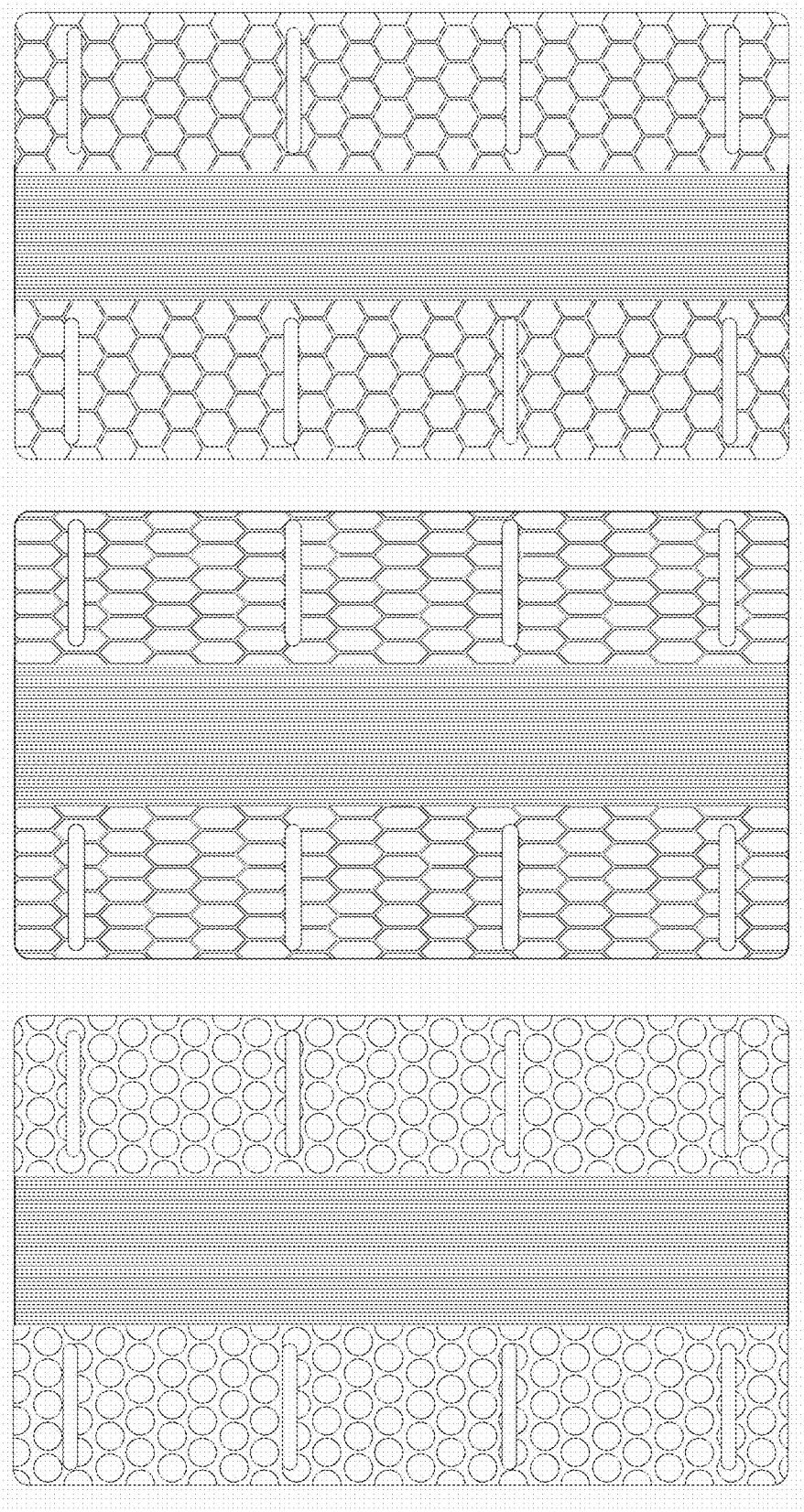
FIG. 27 illustrates exemplary texture for a double leaf hinge portion.

FIGS. 23-25 illustrate an example of a combination of different hinge piece and recess configurations employed in the same case. The lid, in this example, employs a recess analogous to the one disclosed in FIG. 17. The recess is completely enclosed as a hidden cavity within the wall of the lid. It's only visible via a sectional view in FIG. 25 on the left. The base, in this example, employs a recess analogous to the one disclosed in FIGS. 1, 3 and 5 with a step displacement, anchors and a reinforcement bridge. One can clearly visualize the configuration if FIG. 23 when the case is in an opened position. A perspective outside view in FIG. 24 shows the recess that sits slightly above the base as an extra outside pocket. A two-leaf hinge piece is used in this example. The leaf portion inserted to the lid is continuous and without slits. The leaf portion inserted into the base employ slits, which are further restricted by corresponding anchors and the reinforcement bridge.

The protective case and the hinge piece may be manufactured from a variety of materials including thin metal, such as stainless steel, titanium, aluminum or any metal alloy, rigid fabric, carbon fiber, epoxy resin, graphite, rubber, plastic, or any combination thereof.

Plastic comprises a wide range of synthetic or semi-synthetic polymerization materials, such as any one or more of the following in combination: Polypropylene (PP), Polyethylene (PE), Polyurethane (PU), Ethylene-Vinyl Acetate (EVA), polystyrene, high impact polystyrene, polyethylene terephthalate, nylon, Silicone, acrylonitrile butadiene styrene (ABS), Bayblend® blends, and polyvinylidene chloride (PVC). Plastics can also be made with organic condensation, additional polymers, and/or other additive substances to improve performance or for economic reasons.

While various embodiments of the present disclosure have been described above, it should be understood that they have been presented by way of example only, and not of limitation. Likewise, the various diagrams may depict an example architectural or other configuration for the disclosure, which is done to aid in understanding the features and functionality that can be included in the disclosure. The disclosure is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to achieve the desired features of the present disclosure. Also, a multitude of different constituent module names other than those depicted herein can be applied to the various partitions.

Although the disclosure is described above in terms of various exemplary embodiments and implementations, it should be understood that the various features, aspects and functionality described in one or more of the individual embodiments are not limited in their applicability to the particular embodiments with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or"

should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. Certain features described in the context of various embodiments are not to be considered essential features of those embodiments, unless the embodiment is inoperative without those elements.

What is claimed is:

1. A protective case for a computing device, comprising a first cover, a second cover, and a hinge piece connecting the first and second covers;

the first cover is configured to continuously enclose a first portion of the computing device's main body and to capture at least a first portion of the computing device's perimeter, with a first row of knuckles situated along an edge abutting the second cover in parallel to a shaft of rotation of the computing device;

the second cover is configured to continuously enclose a second portion of the computing device's main body, and to capture at least a second portion of the computing device's perimeter; a recess is disposed between the second cover and the computing device with its length and width set to enclose that of a leaf portion of the hinge piece; and the hinge piece comprises a second row of knuckles in complement to that of the first row of knuckles on the first cover, and the leaf portion that is flexible and slides within the recess with a range that supports the first and second covers to rotate from a fully closed position to a fully opened position.

2. The protective case for a computing device of claim 1, wherein the leaf portion of the hinge piece further comprises a plurality of slits which serve as tracks to allow relative motion between the slits and a plurality of raised positioners fixed onto the recess of the second cover.

3. The protective case for a computing device of claim 1, wherein the first and second row of knuckles are joined via a pin through barrels of the first and second rows of knuckles.

4. The protective case for a computing device of claim 1, wherein the first and second row of knuckles are joined via magnetic forces.

5. The protective case for a computing device of claim 1, wherein the first and second row of knuckles snap into one another via a figure-ground configuration.

6. The protective case for a computing device of claim 1, wherein the first and second row of knuckles are replaced by a plurality of pairs of latches and receiving slots, wherein the latch comprises a hook profile.

7. The protective case for a computing device of claim 1, wherein the recess is raised above the second cover via a preset displacement.

8. The protective case for a computing device of claim 1, wherein the recess sits flush with outside surface of the second cover.

9. The protective case for a computing device of claim 1, wherein the recess is configured to be completely enclosed within walls of the second cover.

10. The protective case for a computing device of claim 1, wherein the hinge piece comprises preset textures.

11. A protective case for a computing device, comprising a first cover, a second cover, and a hinge piece connecting the first and second covers;

the first cover is configured to continuously enclose a first portion of the computing device's main body and to capture at least a first portion of the computing device's perimeter, a recess is disposed between the first cover and the computing device with its length and width set to enclose that of a leaf portion of the hinge piece;

the second cover is configured to continuously enclose a second portion of the computing device's main body, and to capture at least a second portion of the computing device's perimeter, with a first row of knuckles situated along an edge abutting the first cover in parallel to a shaft of rotation of the computing device; and the hinge piece comprises a second row of knuckles in complement to that of the first row of knuckles on the second cover, and the leaf portion that is flexible and slides within the recess with a range that supports the first and second covers to rotate from a fully closed position to a fully opened position.

12. The protective case for a computing device of claim 11, wherein the leaf portion of the hinge piece further comprises a plurality of slits which serve as tracks to allow relative motion between the slits and a plurality of raised positioners fixed onto the recess of the first cover.

13. The protective case for a computing device of claim 11, wherein the first and second row of knuckles are joined via a pin through barrels of the first and second rows of knuckles.

14. The protective case for a computing device of claim 11, wherein the first and second row of knuckles are joined via magnetic forces.

15. The protective case for a computing device of claim 11, wherein the first and second row of knuckles snap into one another via a figure-ground configuration.

16. The protective case for a computing device of claim 11, wherein the first and second row of knuckles are replaced by a plurality of pairs of latches and receiving slots, wherein the latch comprises a hook profile.

17. The protective case for a computing device of claim 11, wherein the recess is raised above the first cover via a preset displacement.

18. The protective case for a computing device of claim 11, wherein the recess sits flush with outside surface of the first cover.

19. The protective case for a computing device of claim 11, wherein the recess is configured to be completely enclosed within walls of the first cover.

20. The protective case for a computing device of claim 11, wherein the hinge piece comprises preset textures.

* * * * *